US006641346B2

(12) United States Patent
Bagrosky

(10) Patent No.: US 6,641,346 B2
(45) Date of Patent: Nov. 4, 2003

(54) AUTOMATIC PAPER FEEDER FOR PAPER HOLE PUNCH

(75) Inventor: Frank L. Bagrosky, Boise, NY (US)

(73) Assignee: Performance Design, Inc., Boise, ID (US)

( * ) Notice: Subject to any disclaimer, the term of this patent is extended or adjusted under 35 U.S.C. 154(b) by 141 days.

(21) Appl. No.: 09/778,383

(22) Filed: Feb. 5, 2001

(65) Prior Publication Data

US 2001/0048863 A1 Dec. 6, 2001

Related U.S. Application Data

(60) Provisional application No. 60/180,470, filed on Feb. 3, 2000.

(51) Int. Cl.[7] ..... B42B 5/08; B65H 1/00

(52) U.S. Cl. ..... 412/38; 271/8.1

(58) Field of Search ..... 271/3.04, 8.1, 271/18; 83/210; 412/1, 3, 9, 38

(56) References Cited

U.S. PATENT DOCUMENTS 4,253,652 A * 3/1981 Steinhilber ..... 271/8.1
5,239,904 A * 8/1993 Yamaguchi et al. ..... 83/210
5,527,026 A * 6/1996 Padget et al. ..... 271/21

* cited by examiner

*Primary Examiner*—Willmon Fridie, Jr.
(74) *Attorney, Agent, or Firm*—Pedersen & Co., PLLC; Ken J. Pedersen; Barbara S. Pedersen

(57) ABSTRACT

Embodiments are shown and described of an automatic feeder for handling and inserting media, such as paper, into a hole punch machine or other media processing apparatus. The preferred feeder may accomplish a sequence of steps and preferably includes the apparatus, programming, and methods to accomplish the steps, which preferably handle the paper or other media substantially vertically. A generally vertical pile of paper is advanced forward perpendicularly to the plane of the paper sheets, and then a front portion of the pile is picked by a stabber pushing up in-between the sheets. The picked stack of papers is moved vertically downward into a punching die assembly, and then is ejected laterally to a tray. The picking assembly is designed for a high degree of accuracy. The invented feeder system preferably includes features that allow loading and unloading of the feeder without shutting down the feeder or shutting down the hole punch. This transforms a manual-feed hole punch into a substantially-automatic-feed hole punch, which is beneficial for copy and print shops and other corporations and business with binding and printing needs.

17 Claims, 12 Drawing Sheets

AUTOMATIC PAPER FEEDER FOR PAPER HOLE PUNCH

This application claims priority of my prior provisional patent application U.S. Serial No. 60/180,470, filed Feb. 3, 2000, entitled, "Automatic Paper Feeder for Paper Hole Punch" which provisional patent application is hereby incorporated herein by reference.

BACKGROUND OF THE INVENTION

1. Field of the Invention

The present invention relates, generally, to handling of sheets of paper for book and notebook binding processes. More specifically, the present invention relates to automatic feeder mechanisms for feeding a plurality of sheets of paper into a hole punch machine.

2. Related Art

Hole punch machines are commonly used in copy-centers, print-shops, corporate audiovisual centers, and other facilities that are responsible for binding notebooks, books, convention booklets, and other information packages. These machines punch holes along one edge of the paper, for spiral binding, for example. An example of one such machine is the open-end punch produced by Performance Design, Inc. of Boise, Id. under the trademark of the Rhin-O-Tuff™ HD 7000™ paper punch unit. Such a paper punch and its punch die assembly are illustrated in FIGS. 1 and 2 and U.S. Pat. No. 5,771,768.

Such a hole punch machine (1) features a die assembly (2) with a longitudinal opening/slot (3) in the die into which the edge of a small stack of paper is inserted. Once the paper is in proper position, the punch machine is activated and the punch pins (not shown) are pushed across the slot through the paper to form the holes. The paper is then removed, preferably by being slid out an open end of the die assembly or by being pulled up out of the die assembly. The punched paper is stored elsewhere for further processing and binding. In general, the punching process may be said to include placing a plurality of papers (referred to hereafter as a "stack of paper") into the die assembly in a direction generally perpendicular to the direction of punch pin movement.

Such a hole punch machine (1), and possibly others on the market or in the patent literature, would benefit from an automatic paper feed system that would remove the need for the user to manually feed stacks of paper into the paper punch and manually remove the stacks of paper from the punch after punching. Automating the paper-handling feature of such a paper punch machine greatly increases the efficiency of using the machine, and the consistency and accuracy of paper placement and punching.

SUMMARY OF THE INVENTION

The present invention comprises an automatic paper feeder for a paper hole punch machine. The automatic paper feeder repeatedly provides a selected stack of paper sheets to a hole punch die assembly. The preferred paper feeder may be easily retrofit onto a conventional paper punch that receives paper vertically. After punching of the stack, the paper feeder preferably automatically ejects each punched stack into a tray from which the paper may be later removed without interrupting the feeding and punching operation. Preferably, the paper being fed to the punch is stored generally vertically, is fed to the die assembly generally vertically, and is ejected from the punch machine generally vertically.

The preferred paper feeder comprises a picking mechanism that accurately separates a stack of paper from a larger pile of paper in a stocking area, and a mechanism for moving the stack of paper into the die assembly for punching. The preferred paper feeder also includes a mechanism for removing the punched paper from the machine for further processing. The preferred picking mechanism comprises a picking mechanism that includes intake rollers closely adjacent to, and moving with, a stabbing member, resulting in an accurate, economical, and predictable picking system. The preferred stabbing member is closely adjacent to paper stops that help control the location of the paper being advanced for picking, an arrangement that contributes to accuracy and predictability.

The invention may also include a reception tray for receiving the punched paper upon its exit from the hole punch machine, so that paper removal may be done only occasionally as needed or when the reception tray becomes full. This way, a large pile of paper may be stocked onto the feeder, and punched paper may later be removed for binding or other processing at a convenient time and in a convenient amount.

An object for the preferred paper feeder is to separate "stacks" of one or more sheets of paper or other material from a large pile of paper and sequentially insert them into the paper punch. The preferred feeder is designed to separate stacks of about 5–25 sheets, depending on the media and on adjustment made to the belt movement or paper stop mechanisms, and, typically, for conventional copy paper, a stack of 10–15 sheets of paper is optimum. A pile of about 2500 or more sheets of paper/media fits conveniently on the preferred feeder. Special features for efficient and accurate handling of the paper pile and of each stack of paper are preferably included in the paper feeder and reception tray, so that the stacks are handled in quick succession to match the speed of the paper punch, for example, in the range of about 18,000–30,000 sheets per hour. For the preferred paper punch, which may operate at about 35punch cycles per minute, the automatic paper feeding and large pile of paper stock offered by the invented system increases speed and improves accuracy of paper punching.

BRIEF DESCRIPTION OF THE DRAWINGS AND PHOTOGRAPHS

DESCRIPTION OF THE PREFERRED EMBODIMENTS

Figure 1:
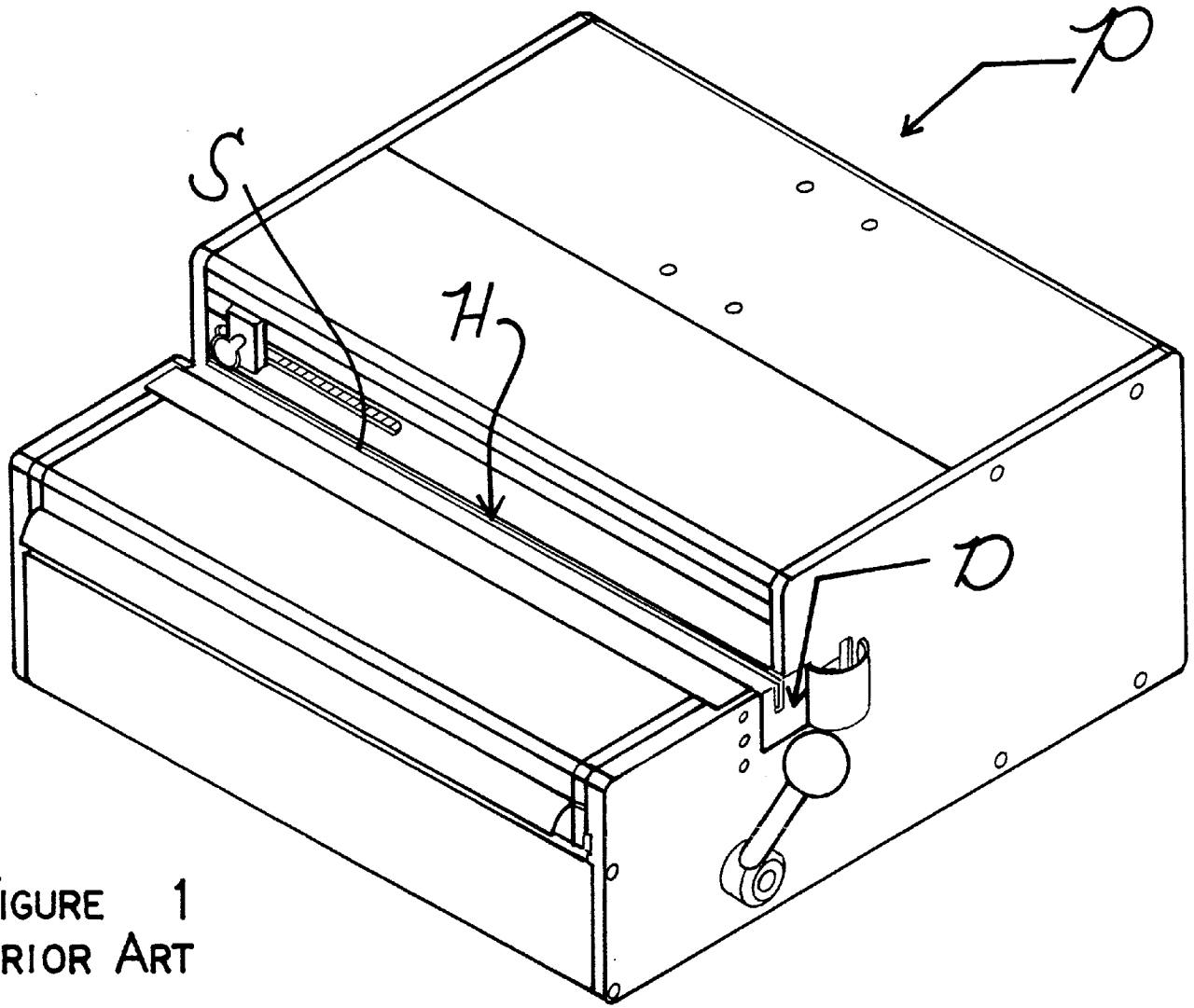
FIGURE 1 PRIOR ART
FIG. 1 is a right-front perspective view of one embodiment of a prior art hole punch that may be adapted for use with an embodiment of the invented paper feeder.
Figure 2:
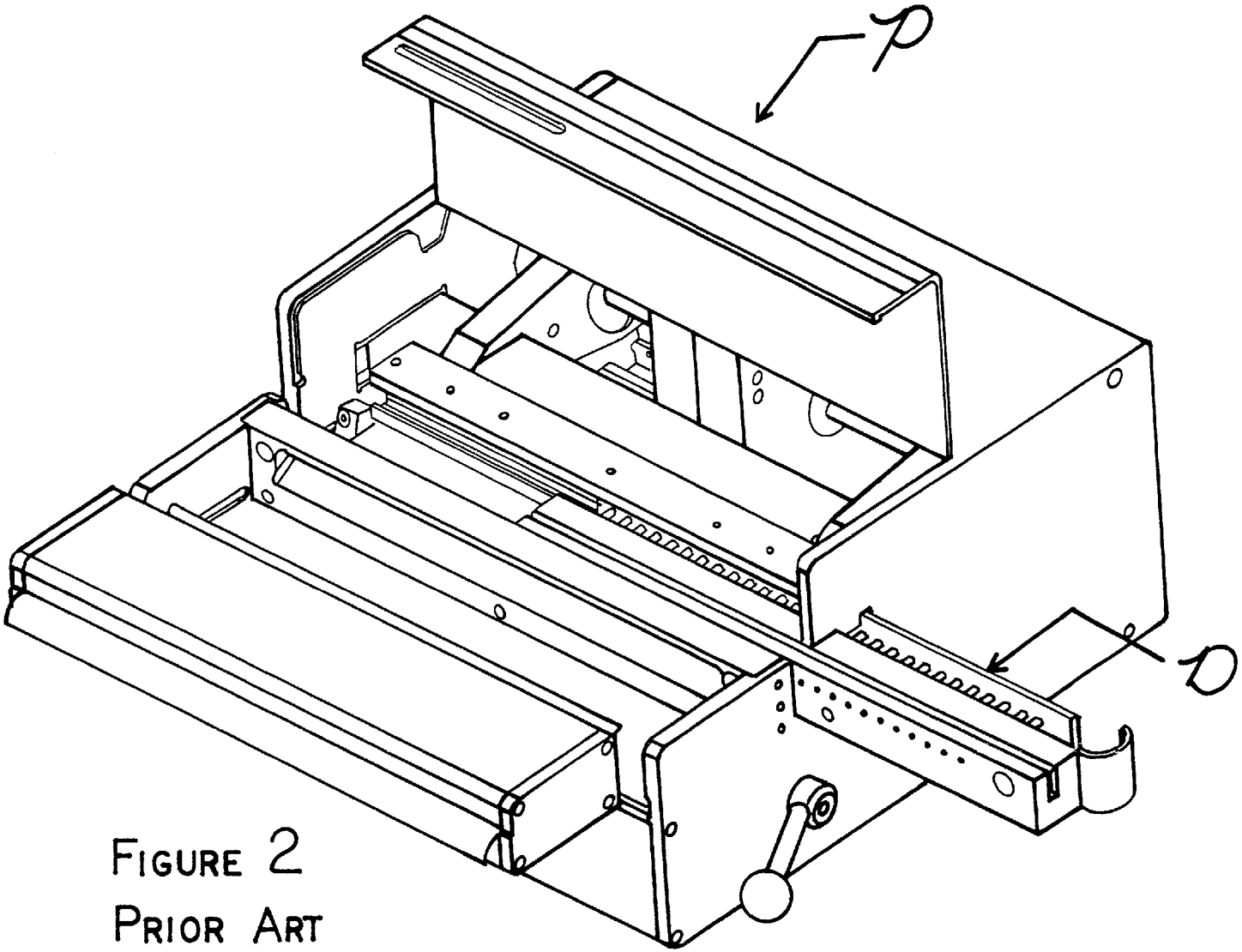
FIGURE 2 PRIOR ART
FIG. 2 is a right-front perspective view of the prior art embodiment of FIG. 1, with a die assembly partially pulled out of the hole punch.
Figure 3:
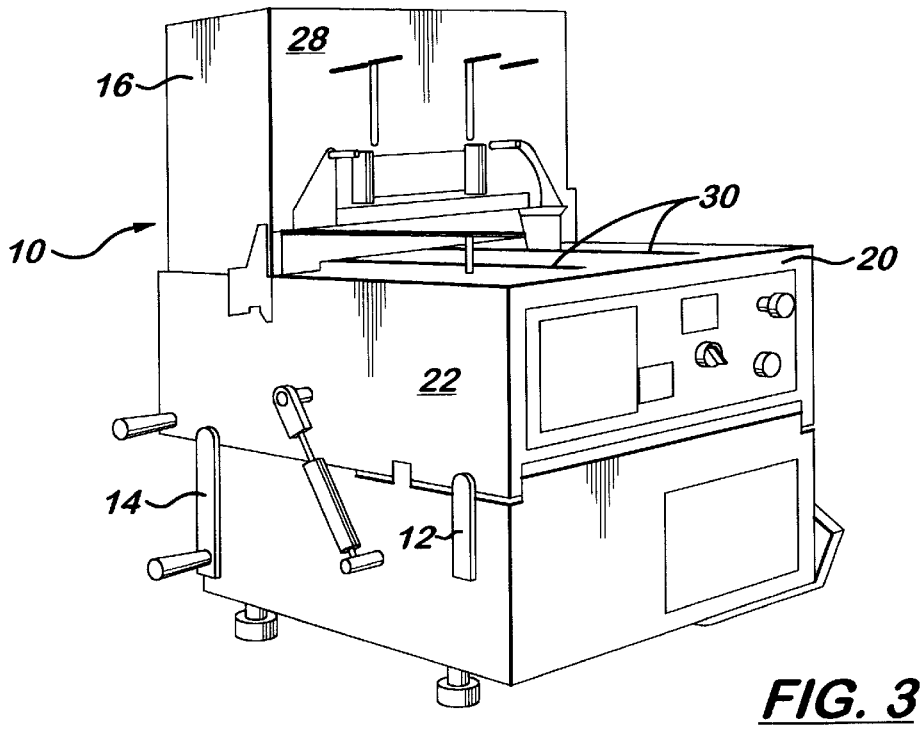
FIG. 3 is a right-rear perspective view of one embodiment of the invented paper feeder, shown installed on top of a hole punch similar to the hole punch of FIGS. 1 and 2.
Figure 4:
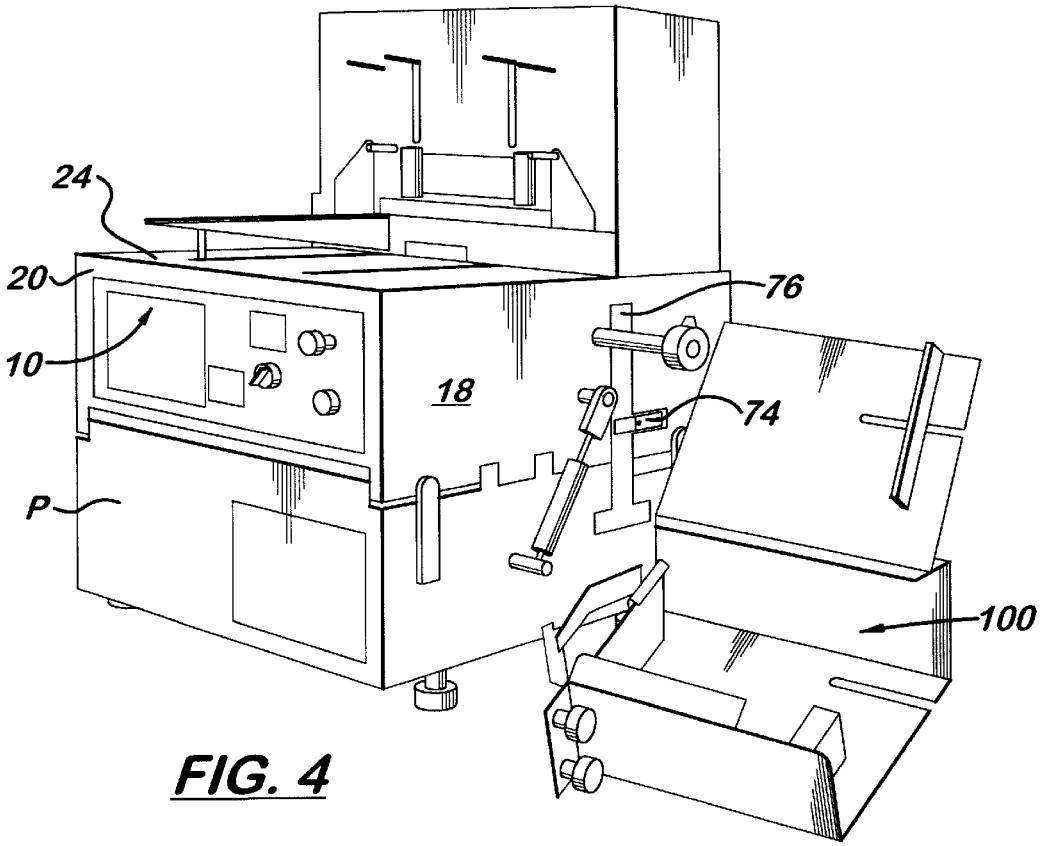
FIG. 4 is a left-rear perspective view of the embodiment of FIG. 3, revealing an embodiment of a paper reception tray installed near the paper outlet of the hole punch and paper feeder.

Referring to the Figures, there is shown the preferred, but not the only, embodiment of the invented paper feeder for a hole punch machine. FIGS. 1 and 2 illustrate the preferred type of punch machine (P) with which the invented paper feeder may cooperate. The inventive features of the paper feeder may be used in cooperation with other machines, for example, other hole punches or paper binding machines, and this Description is not intended to limit the applications of the invention, but rather to illustrate preferred embodiments. Also, throughout this Description, the term "paper" is used, but the invention is not limited to handling paper, but rather may be used for handling of various sheet materials that are to be punched, for example, plastic sheets.

The die assembly (D) is shown in FIGS. 1 and 2, and the slot into the paper edge is inserted or falls is shown at "S". The die assembly slides generally horizontally into the machine with the slot S in a vertical plane and extending longitudinally substantially the length of the die assembly. The slot opens to the top and to the ends for receiving paper to be punched and for removal of the punched paper. In FIGS. 1 and 2, one may see the hole punch housing opening "H" into which the paper is normally inserted, in a downward, vertical direction.

The preferred embodiment of the paper feeder 10 is shown in the Figures attached to the top of the punch machine P. Preferably, the feeder 10 is pivotally and removably attached to the punch P at hinge 12 near the rear of the punch P and is latched near the front at latch 14. This way, the feeder 10 may be pivoted up away from the punch P for servicing of either punch or feeder.

Figure 5:
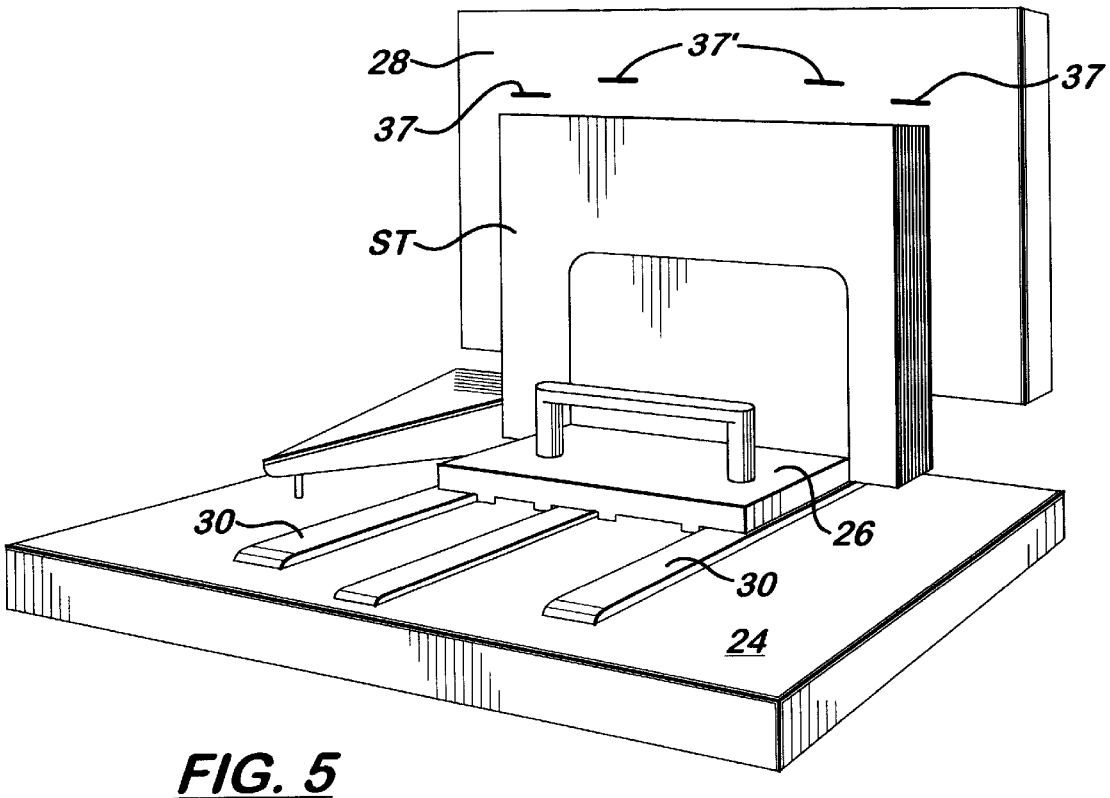
FIG. 5 is a left-front detail perspective view of the paper stocking area, wherein a small, generally vertical pile of paper rests on the paper feeder, fully advanced by the advancement belts and supported in the vertical position by a weight.

The feeder 10 has a generally L-shaped housing with a front side 16, left side 18, rear side 20, right side 22, and top surface 24. The paper pile or stock is placed on the top 24 with the sheets running generally vertically, as shown in FIG. 5. The top surface 24 is slightly slanted at about 10–12 degrees downward toward the front, so that the paper pile tends to lean forward toward the "inner surface" 28. A weight 26 is placed on the top surface to aid in keeping the paper pile in place and moving toward the front. Two belts 30 incrementally move the pile forward after each stack of paper is picked from the pile, moved downward to be punched and then removed from the feeder 10. Along the top surface 24 may be strips or other areas of an abrasive or rough material which gently contacts the edges of paper as it is moved across the areas and which serves to fluff the paper, that is, slightly separate and "un-stick" the individual sheets from each other. This improves both the picking process and the stack lowering process (described below) and results in greater accuracy and consistency. The preferred rough areas are strips of hook and loop fastener, preferably the more "bristled" side of the fastener which is the hook side. Two strips of hook fastener may be attached to the top surface parallel to the belts 30, with the strips reaching slightly above the plane of the top surface for contacting the bottom edges of the paper.

Figure 6A:
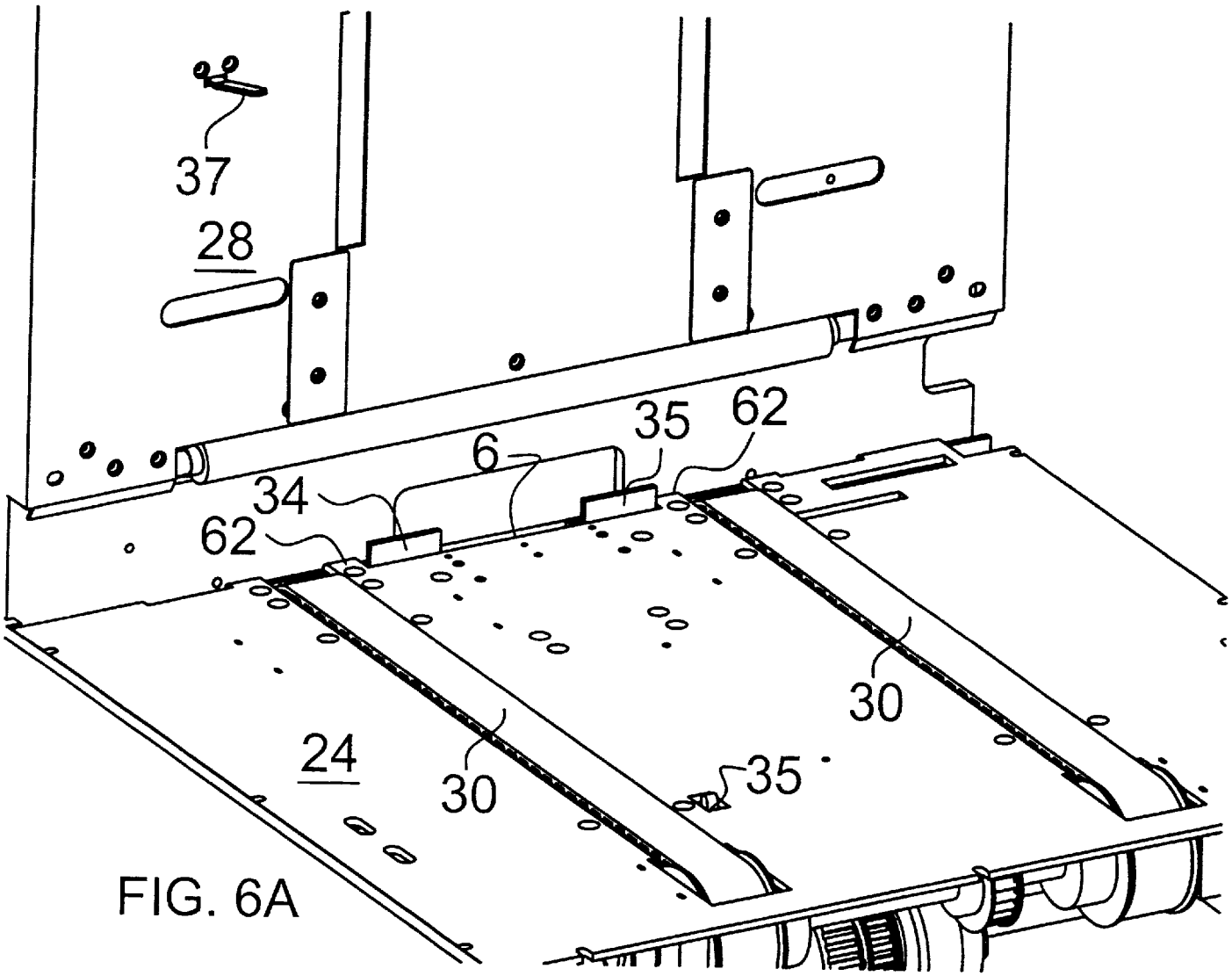
FIG. 6A is a right, perspective detail view of the stocking area without paper or a weight, illustrating the paper stops in the up-position.
Figure 6B:
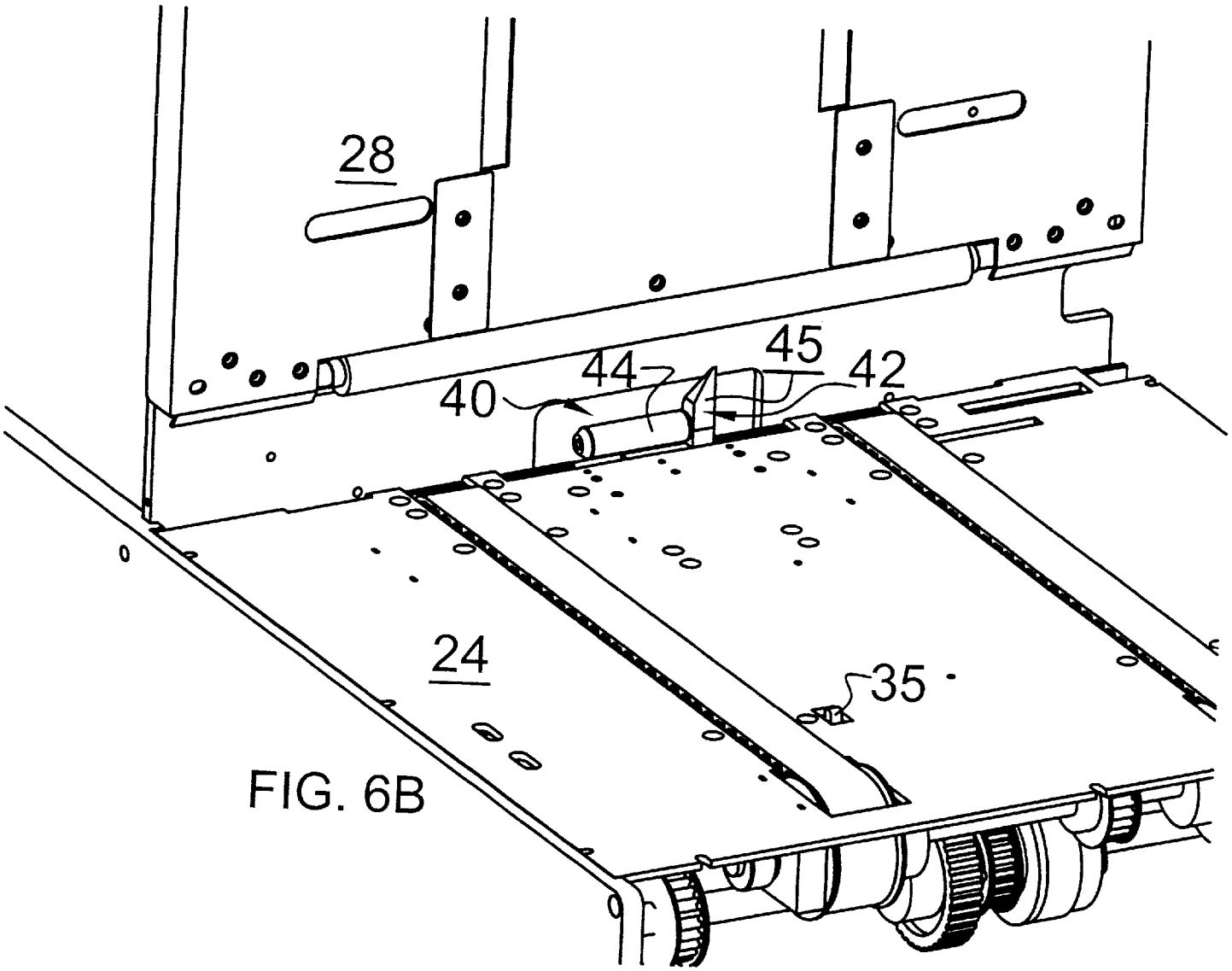
FIG. 6B is a right, perspective detail view of the stocking area of FIG. 6A, with paper stops retracted into a down-position and the picking mechanism raised up.

The belts 30 move the paper pile toward the inner surface, where the inner-most sheet abuts against paper stop(s) 34, as shown in FIGS. 6A, 6*a,* and 7. The stops 34 are in the raised position when the picking assembly 40 is in the retracted (down) position, as shown to best advantage in FIGS. 6A and 7. Picking assembly 40, includes stabber 42 and idler wheel(s) 44, which is preferably one wheel 44 rotatably attached to the stabber on either side of the stabber 42, but preferably on the left side of the stabber as in FIG. 6A.

Figure 7:
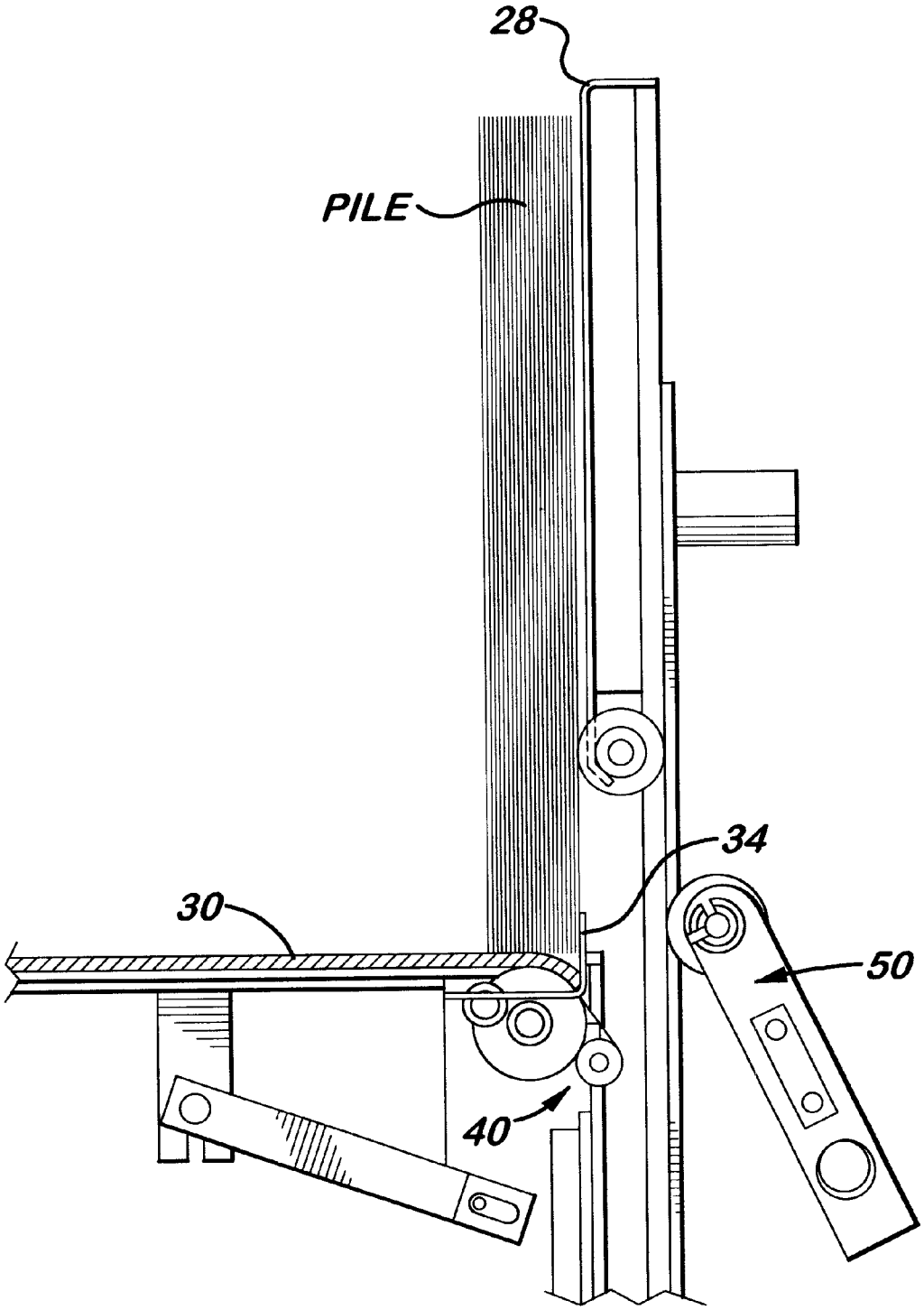
FIG. 7 is a left detail view of the stocking and picking system, shown with the paper pile generally in the position as in FIG. 5, fully advanced against the raised paper stops, and with the feeder roller swung away from the paper.
Figure 8:
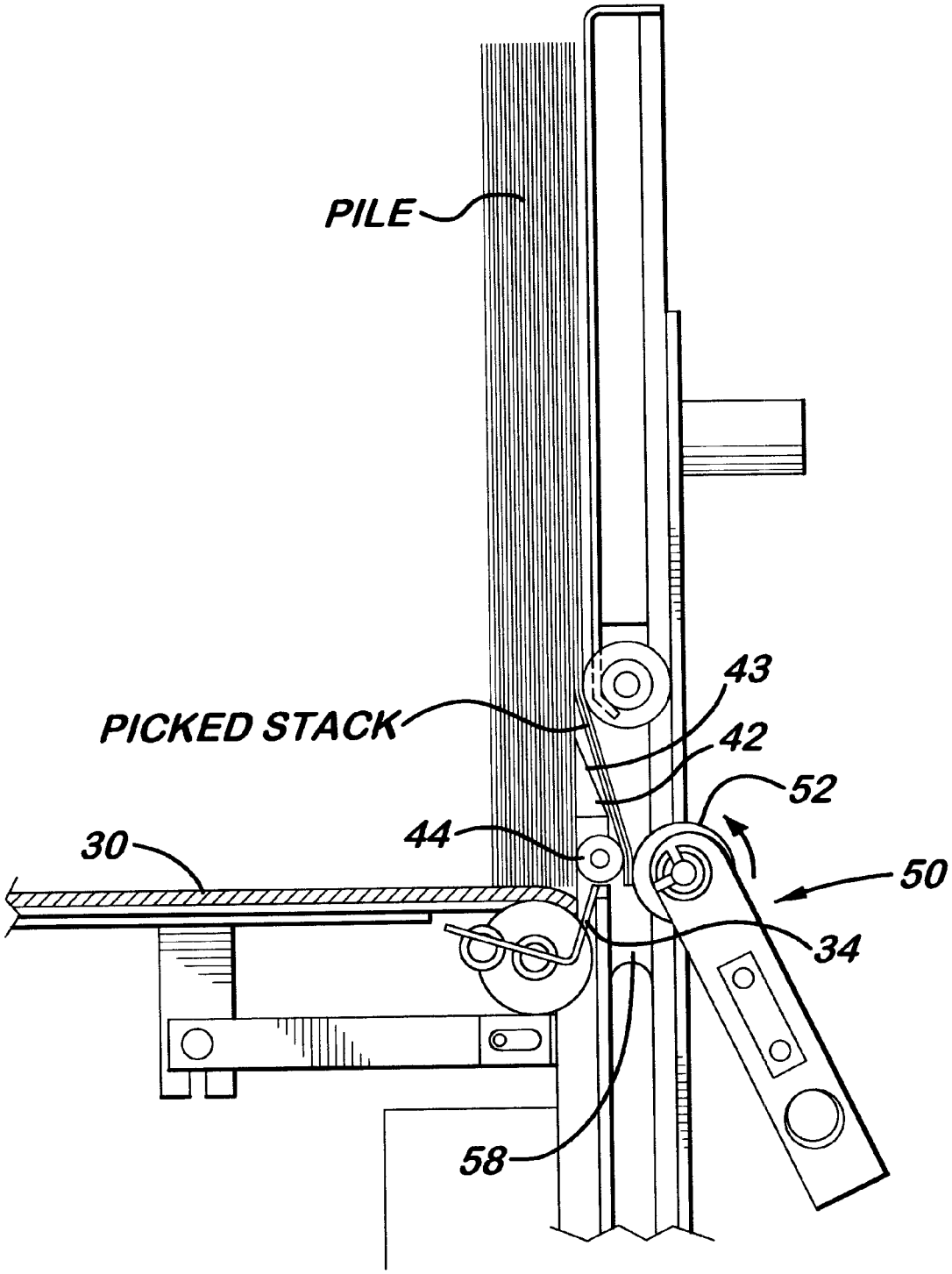
FIG. 8 is a left detail view of the stocking and picking system of FIG. 7, wherein the paper stops have been lowered and picking mechanism raised to pick a stack of paper, and wherein the feeder roller is swung in against the picked stack of paper to lower it into the die assembly.
Figure 9:
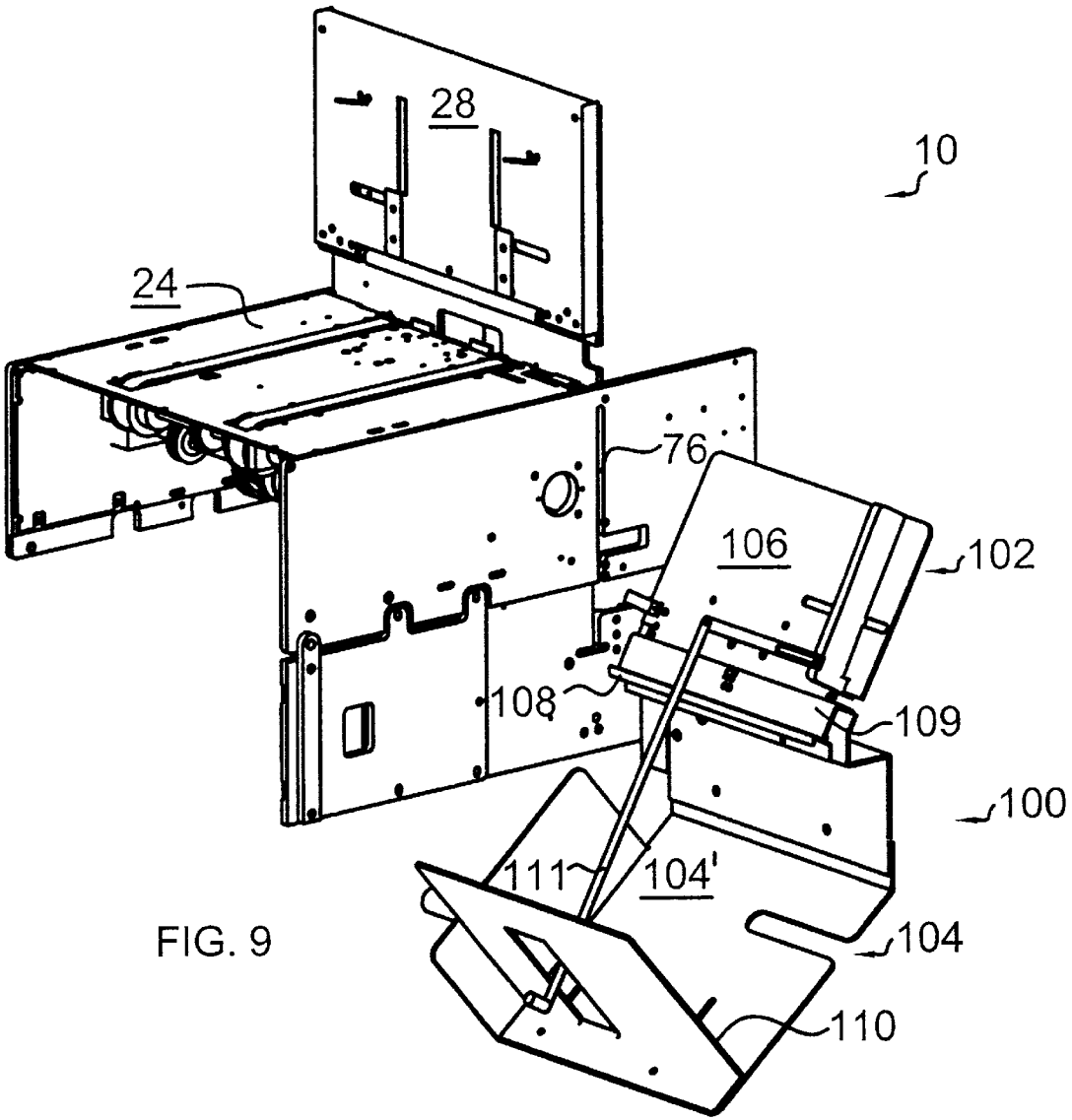
FIG. 9 is a left-rear perspective view of another embodiment of the paper feeder, shown with the rear panel of the paper feeder removed to partially show the under side of the paper advancement system, and shown with a preferred reception tray installed near the paper feeder.

After the belts 30 incrementally move the pile forward to place the front sheet against the stops 34, the picking assembly 40 moves upward toward the bottom edges of the paper pile at a preset (adjustable) distance into the pile. The stabber 42, with its pointed and slanted front top surface 43 and its generally vertical rear surface 45, slides between two paper sheets to separate the desired stack of paper from the bulk of the pile, as shown in FIGS. 7 and 8. The slanted front top surface 43 acts to urge the bottom edges of the picked sheets forward for subsequent contact by the feed roller mechanism, described below.

Thus, one may see that the amount of picking is determined by the relative placement of the stops 34 and the stabber 42, because the pile is moved forward as far as the stops will permit and then the stabber raises up and separates a picked stack of paper at a set position, which results in the distance between the rear surface of the stops and the rear surface being approximately the thickness of the picked stack. Preferably, the stabber is closely adjacent to one of the stops, without rollers of other structure laterally between the stabber and said one stop. This closeness of the stabber and the stop provides a more accurate picking action, which is believed to be because there is likely to be little or no buckling of the paper between the stop and the area in which the stabber raises. This way, the stabber stabs up into firmly-positioned and straight sheets of papers is likely to pick precisely the amount of papers desired.

Figure 11:
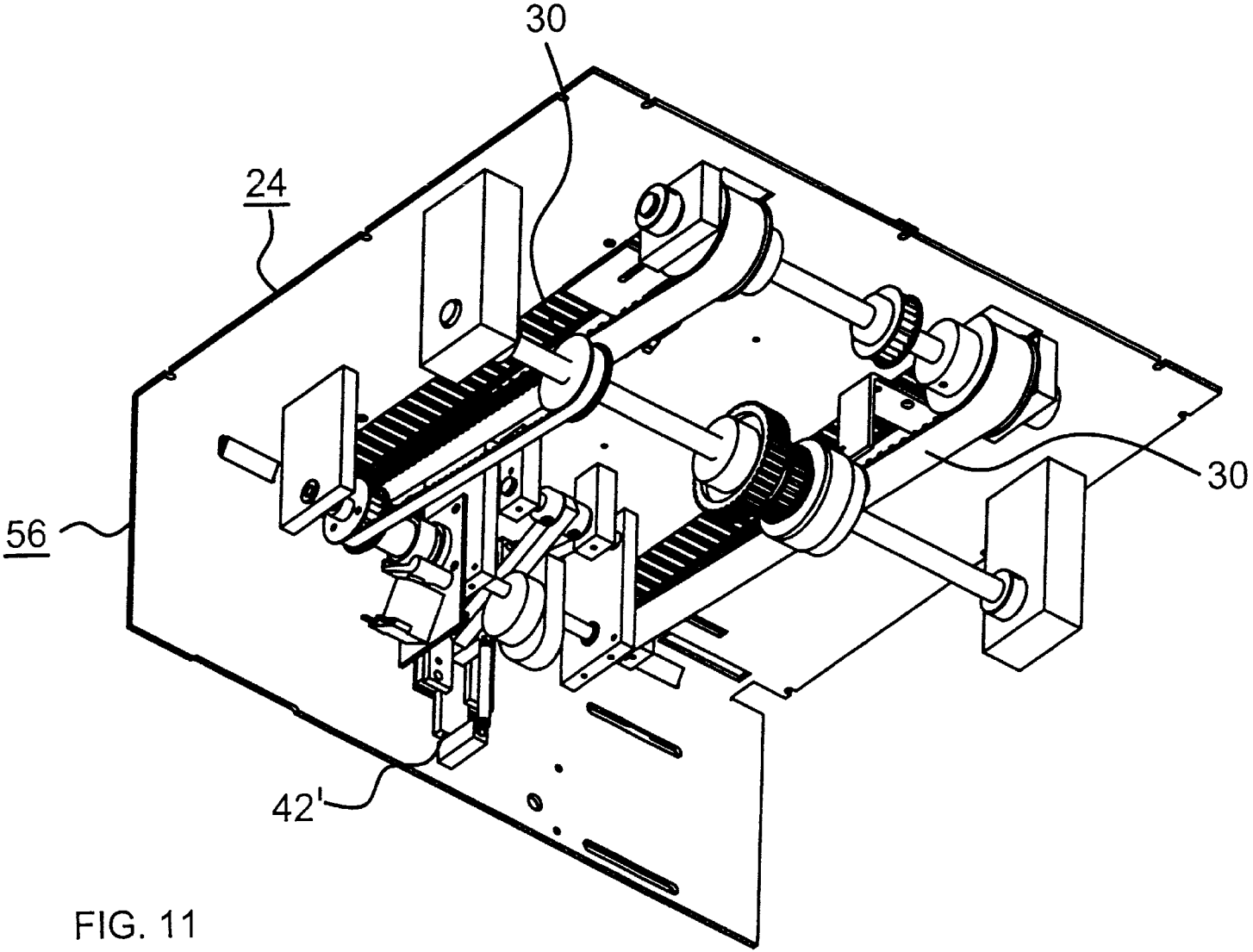
FIG. 11 is a bottom, left-rear perspective view of one embodiment of the paper advancement system.

The stops 34 are timed with the picking assembly 40, so that the stops retract downward, as the picking assembly 40 moves upward, as best illustrated in FIGS. 7 and 8. After the picking assembly 40 is in the raised position, the paper feed roller mechanism 50 pivots inward (counter-clock-wise in FIGS. 7 and 8) so that the feed roller 52 contacts the front sheet of the stack. This way, the lower part of the stack is pressed between the feed roller 52 and the idler wheel 44, so that the feed roller rotation drives the stack downward relative to the "un-picked" paper pile generally along surface 56 (see FIG. 11) into space 58 and into the slot S of the die assembly.

To determine the size of stack that is to be picked, various adjustments are possible, for example, preferably the location of the paper stops 34. In one embodiment, which assumes that adjustment of the size of stack only occasionally will be adjusted, the paper stoops 34 are adjusted by accessing the interior of the feeder. Alternatively, for special applications which make more frequent adjustment desirable, easily-accessible adjustors may be designed, or adaptors that fit onto or over the stops 34. Such adaptors (not shown) may be sleeves that fit over the stops to increase the size of the stops, that is, to bring the rear surface of the stops farther toward the rear of the feeder. With such a system, the stops may be located at a relatively forward position, and variously-sized sleeves may be attached to the stops as needed, in effect, to move the rear surface of the stop toward the belts. Less preferably, other systems may be used to affecting the stack size, for example, adjusting the location of the picking mechanism when it extends upward into the stack.

The indexing of the belt movement also affects picking performance and consistency, and controls and sensors may be used to optimize the belt movement during each index step. Preferably, the belt movement is pre-programmed to incrementally move the pile forward, to push the front of the pile against the stops, at a set speed, after the previous step of picking of a stack of paper. Preferably, the belt speed does not change over the wide range of paper pile size, but the amount of time the belt is moving for an incremental forward movement of paper does change. A mechanical friction clutch is preferable, and the time the clutch continues movement of the belt is determined by signals from a programmable logic controller in the feeder 10. The belt may tend to slip underneath the pile somewhat, depending on the weight of the pile, and also a) when the pile is large (heavy), there is more slippage in the clutch system, and b) when the pile is small (light), there is less slippage in the clutch system. To adjust the amount of time the belt(s) move forward for each incremental advancement of paper, one or more switches 35 located on the top surface 24 may be used. Switch 35 is preferably a micro-switch and is activated when the paper pile is large and the weight covers/contacts the switch. When the switch is activated, the programmable logic controller signals the clutch to allow belt movement for a specific, relatively long, amount of time during each incremental advancement. When the pile no longer rests in that particular area of the top surface 24 (actually when the weight moves with the pile forward and clears the switch 35), the switch is released, and the programmable logic controller provides a shorter output to the mechanical friction clutch, which keeps the clutch on for a shorter time of belt movement at the same belt speed. If more than one switch is used along the distance between the rear and the front of the top surface 24, several incremental adjustments of belt movement time are made as the paper pile/weight moves forward. Other systems may be developed for belt movement control, but this has been found to be particularly effective.

Additional equipment may be used to produce accurate picking and paper handling. For example, tabs 62 extend generally parallel to top surface 24. Tabs 62 prevent the paper stack from falling down into the space just in front of edge 6. Tabs 62 may be slightly raised relative to the surrounding top surface 24 and/or have a roughened surface at that position, for providing enough friction against the bottom edges of the paper sheets to prevent bowing in response to the belts pushing the paper forward. Preventing this bowing or bulging of the sheets, for example, their centers relative to their outer regions, helps keep the sheets straight especially in the region of the picking mechanism, for accurate and smooth picking. Additionally, a top-edge stops 37, or adjustable top-edge stops 37', may be included to guide/stop the top edges of the pile/stack, especially if the picking assembly nudges any of the paper upward. Additionally, it is envisioned that a system for reducing static electricity on the paper sheets may be added (not shown), such as a blast of ionized air directed at the sheets to reduce the static. This static-reduction would especially be useful in the handling of plastic sheets, which are prone to static buildup.

After each stack of paper rests fully inserted down into the slot of the die assembly, joggers are used to align the paper stack properly in the die assembly. Preferably, a lateral jogger included in the feeder moves out and then inward to tap one or more times against the end of the paper set in the die assembly. Also, preferably, one or more top joggers move out to tap down on the top edge of the paper stack. After this alignment of the paper stack, which replaces the manual tapping and alignment of each hand-inserted stack that a user would have to do, the hole punch machine is actuated and holes are punched in the paper. Prior to the punched paper stack being removed from the punch machine-feeder combined unit, the joggers retract out of the way of the paper.

Figure 10A:
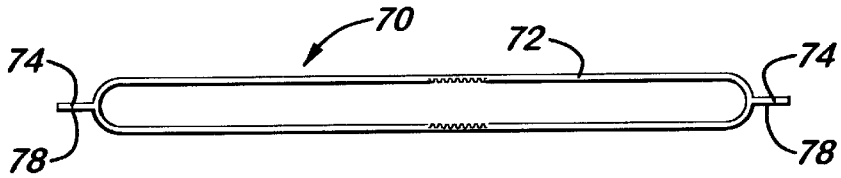
FIG. 10A is a top view of one embodiment of a paper ejection belt that may be used to move a punched paper stack laterally from the paper feeder.
Figure 10B:
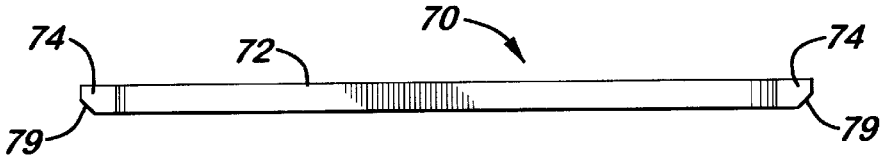
FIG. 10B is a front side view of the belt of FIG. 10A.

Paper removal is actuated by a timed device that slides the paper stack sideways (longitudinally, horizontally) out the end of the die assembly. The preferred removal mechanism is belt 70, located in front of and above the slot in the die assembly. Belt 70 is a paddle belt which comprises the belt portion 72 and two paddles 74 at opposite end of the belt when it is in an elongated position as shown in FIGS. 10A and B. During insertion of the paper stack into the die assembly, the belt is in the position shown in FIGS. 10A and 10B. When the paper stack is to be removed from the die assembly, the belt 70 moves to place one paddle against the end edge of the paper (near the right side of the machine) and the paddle then pushes the paper sideways out of the die assembly. When the belt has traveled ½ revolution, the paddle that has pushed the paper has moved to the left side of the machine and paper has slid out of the paper exit 76 in the left side. The paddles may be variously shaped, but preferably have a flat surface 78 for contacting the paper end edges. The paddles shown in FIG. 10B has optional rounded/angled comers 79, which are not involved in the process of contacting paper, but are merely to clear other structure inside the preferred feeder as the belt moves.

The paper reception tray 100 is preferably connected to, or placed next to, the feeder 10 near the paper exit 76. The punched stacks of paper slide sideways into the upper or top tray 102, which comprises a generally upright but slightly slanted surface 106, lip 108, and pusher bar 109. The pusher bar may be timed as desired to push the bottom of the stack rearward (toward bottom tray 104) to drop the stack or stacks accumulated generally vertically onto the top tray 102 into their resting generally horizontal position in the bottom tray 104. Other pushing/dropping mechanisms may be designed to move the accumulated stack(s) from the generally vertical tray into the generally horizontal tray. The punched stacks accumulate in the bottom tray 104 for easy removal by a user, without the need to stop the punch machine or the feeder. While the orientation of the surface 104' of bottom tray 104 is said to be generally horizontal, there may be some rearward slanting to it to encourage paper to move fully to abut against the rear wall 110 in a neat orderly stack. To further encourage orderly and neat stacking of punched paper in bottom tray 104, a flexible guide strap 111 may extend from the top tray 102 (from a position out, rearward from the paper resting in top tray 102) and slanting downward to near the rear of the bottom tray. This strap 111 serves to guide paper as it is pushed into the bottom tray, to prevent curling or flying or mis-aligned paper.

Various features may be added to the tray 100, for example, a vibrator for aligning the paper in the bottom tray in position against one corner (assuming the floor of the bottom tray is slightly slanted toward that corner). Or, a paper deflector may be installed near the inside surface 110 of the bottom tray (not shown) to hold the accumulated paper out from the surface 110 slightly for easier access and removal. Slot 112 allows the user to grasp paper with shutting down any of the systems. Other stationary guides or movable guides, such as guides 114, 115, 116, may be added for paper alignment and control, for example, for various sizes or various compositions of media.

Adjustable or selectable stops or joggers may be used to adapt the feeder for handling of media with variously-shaped edges. For example, as one may note in the Figures, adjustable top edge stops 37' are included on the upper portion of the feeder. Also, four tog joggers are preferably supplied inside the upper portion of the feeder for alignment of the paper stack in the die assembly. These mechanisms are provided to adapt the feeder for handling of either tabbed media, wherein the paper/media has a non-straight edge formed by a tab or index, or for handling of straight-edges paper/media. The two adjustable top edge stops 37' are used for straight-edged media, and the two outer stops 37 are used for the tabbed media. Likewise, two inner top joggers are used for straight-edged media, and the two outer joggers are used for tabbed media.

Figure 12:
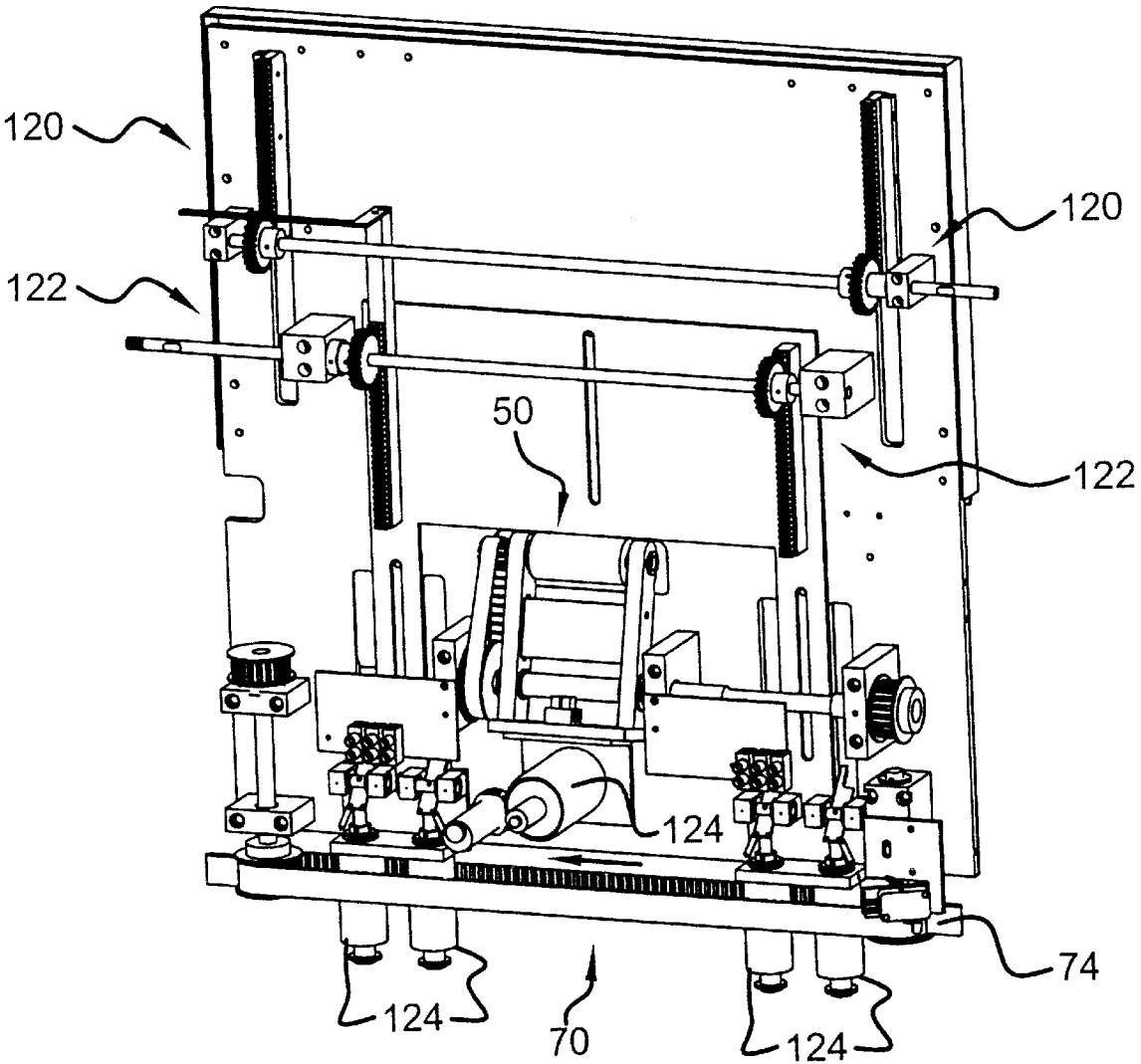
FIG. 12 is a bottom, front perspective view of one embodiment of the paper feeder roller, paper jogger, and paper ejection systems.
Figure 13:
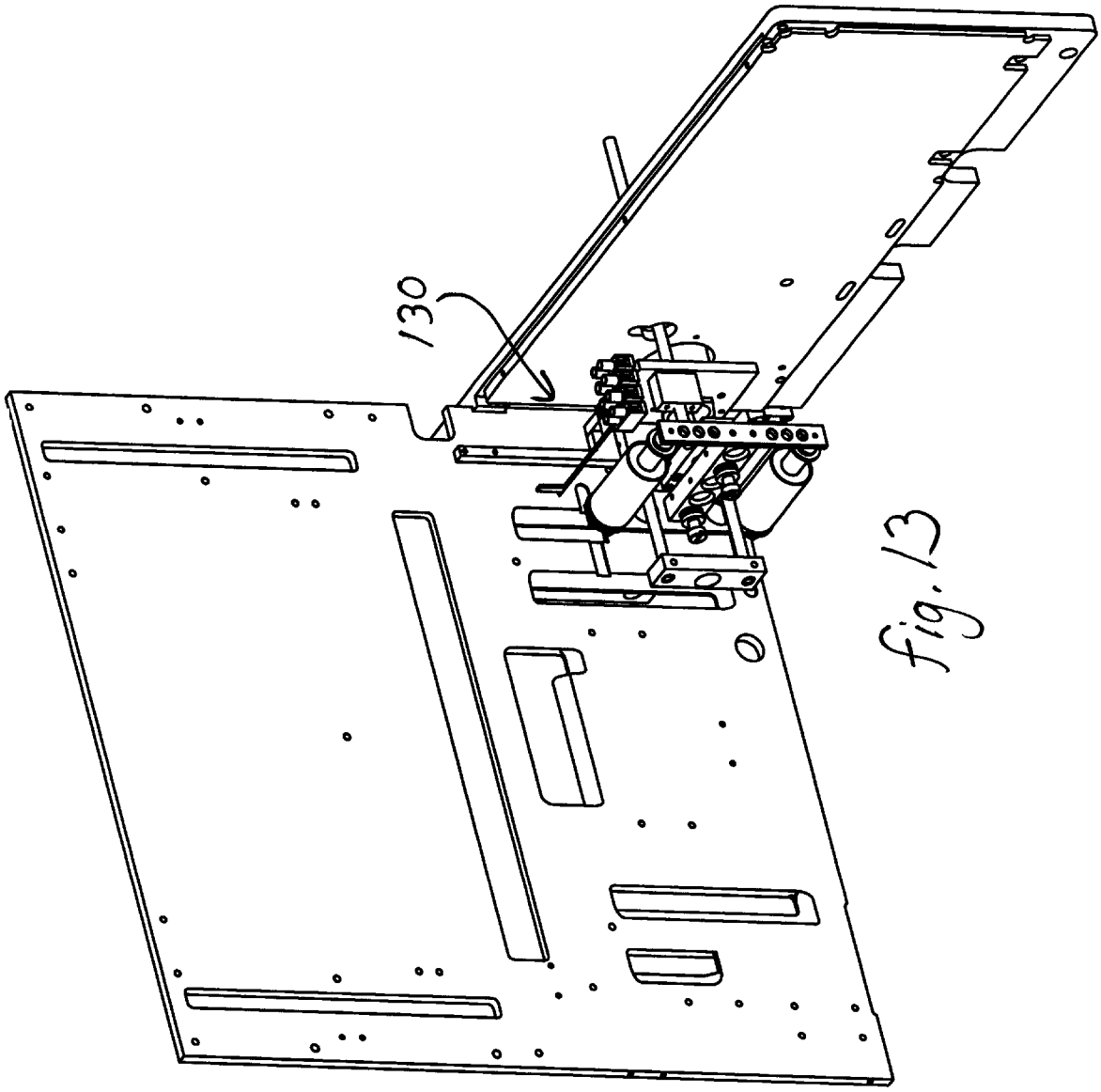
FIG. 13 is a rear, perspective view of one embodiment of a side-jogger system installed in front and left side panels of the paper feeder.

As illustrated in FIG. 12, the internals of the top portion of the feeder may include mechanisms 120 for adjusting top edge stops 37', rack and pinion adjustment 122 for up and down adjustment of top joggers to tap paper downward, along with various solenoids 124 for operation. In FIG. 13, is shown the details of a side jogger 130.

Once the features of the invented feeder for handling sheets of media is understood as described above and as drawn herein, it may be within the skill of one in the art to design the control/electronics systems for proper timing of the various mechanisms described.

An important feature of the invented paper feeder and reception tray system is that they are remarkably insensitive to changes in paper/media condition and ambient conditions. For example, the various features of the invention substantially prevents jamming and other problems due to humidity or static electricity affecting the media being handled.

Summarizing the preferred steps performed with the preferred paper feeder and punch, which preferably involves vertical feeding, punching and ejecting of the paper. In a first step, the feeder incrementally moves a pile of media, preferably with the sheets positioned vertically, toward a picking assembly. In a second step, the picking assembly separates a plurality of sheets of the media from the large pile. In a third step, the feeder moves the "picked" stack away from the remainder of the pile, preferably down generally parallel to the plane of the sheets in the pile. This third step moves the stack into a station for processing, such as a die assembly in a hole punch. In a fourth step, joggers preferably automatically align the sheets of the stack in the station to correct any misalignment that may have occurred during the earlier steps. The fifth step is the processing step, preferably hole punching, performed by the station. Once this processing is complete, the feeder performs the sixth step which moves the media away from the station, preferably moving the stack parallel to the plane of the sheets but laterally in a direction perpendicular to the direction of movement in the third step above. Upon exiting the station, the stack preferably moves into a holding position in a reception tray that places the stack substantially in the same orientation as when it exits the station, preferably substantially vertical. After one or more stacks accumulate in this holding position, the reception tray ejects the stack(s) into a final resting position separate from the holding position, which is preferably a horizontal portion of the reception tray, for easy access by a user without any interference with the feeder or the exiting stack(s).

An important feature of the invented paper feeder and reception tray system is that it may be used continuously, while paper is added to the pile on top of the feeder, and paper is removed from the reception. The user need not stop the machine to add paper, because the vertically-positioned pile of paper, the picking from the front of the pile, and the vertical movement of the picked sheet or sheets of paper, or other media, are not interfered with by adding to the back of the pile. Also, removing paper from the end of the process (the reception tray) does not interfere with the feeding or punching processes, because the exiting paper moves to an intermediate storage position in the top tray, which remains closely adjacent to and at the same level as the paper exit opening of the punch machine, before being ejected into the horizontal position. Thus, during the addition/removal processes, the user's hands do not interfere with, or become endangered by, the equipment or the paper or other sheets being handled. Because most other paper handling systems pick paper from the top of a horizontal stack, a user must stop such a system to add paper to the top of the stack. Also, most systems pile the exiting paper directly on top of an exit stack without any intermediate storage, and require shutdown of the machine for accessing the finished paper.

Although this invention has been described above with reference to particular means, materials and embodiments, it is to be understood that the invention is not limited to these disclosed particulars, but extends instead to all equivalents within the broad scope the following claims.

I claim:

1. A media feeder for use with a media punching machine, the feeder comprising:

a media pile stocking surface having a front edge and a rear edge and adapted to receive a pile of media sheets, each of the sheets having a plane and the plane of the sheets being perpendicular to the media pile stocking surface and facing forward;

a mechanism for moving the pile forward toward the front edge;

a picking mechanism comprising:

a movable stop at or near the front edge, the movable stop being moveable upward to contact and stop the forward-moving pile and the movable stop being moveable downward away from the front edge to allow paper sheets to move forward past the front edge;

a movable stabbing member at or near the front edge, the stabbing member moveable upward to push in-between the sheets of media at a desired distance rearward into the media pile;

wherein, the stabbing member moves upward and pushes between the sheets of media substantially simultaneously with the movable stop moving downward so that a picked number of sheets drop down into a hole punch below the media feeder.

2. A media feeder as in claim 1, wherein the movable stop and the movable stabbing member are closely adjacent.

3. A method of automatically feeding paper to a punch machine, the method comprising:

providing a pile of media on a stocking surface so that sheets of the media are held in vertical planes;

advancing the pile of media forward toward a stop until the pile abuts against the stop; and prior to driving any of said sheets downward away from the pile, performing the steps comprising:

causing a stabbing member to be inserted into the pile a given distance into the pile to separate a desired number of sheets of media are separated at their bottom edges from the pile; and removing the stop so that the separated sheets move substantially vertically downward into a punch die assembly; and then driving the separated sheets downward relative to the pile.

4. The method of claim 3, further comprising punching the separated sheets after said separated sheets are driven downward relative to the pile, and, after punching, ejecting the separated sheets generally vertically out from the die assembly.

5. The media feeder of claim 1, further comprising an idler roller connected to, and adjacent to, said stabbing member, so that said idler roller moves upward with said stabbing member.

6. The media feeder of claim 1, further comprising a feed roller adapted to contact a forward surface of said picked number of sheets to drive said picked number of sheets into the hole punch.

7. The media feeder of claim 5, further comprising a feed roller adapted to contact a forward surface of said picked number of sheets and drive said picked number of sheets downward into the hole punch, wherein said idler roller contacts a rearward surface of said picked number of sheets when the stabbing member moves upward.

8. The media feeder of claim 6, wherein said feed roller is adapted to pivot against the picked number of sheets to contact said forward surface, and wherein said feed roller is pivotal away from the pile after said picked number of sheets are driven into the hole punch.

9. The media feeder of claim 1, wherein said stabbing member is moveable downward, after said picked number of sheets drop down into the hole punch.

10. The media feeder of claim 1, wherein said mechanism for moving the pile forward toward the front edge comprises a belt, and said stocking surface comprises a switch adapted to respond to size of said pile on the stocking surface by adjusting duration of movement of said belt.

11. The method of claim 3, wherein the step of driving the separated sheets downward relative to the pile comprises providing a feed roller and a idler roller on opposite sides of said separated sheets and rotating the feed roller to force said separated sheets downward.

12. The method of claim 11, wherein said idler roller is connected to, and adjacent to, said stabbing member.

13. The method of claim 11, wherein providing said feed roller comprises pivoting the feed roller toward said separated sheets so that the feed roller contacts a forward-most sheet of said separated sheets.

14. The method of claim 3, wherein removing the stop comprises pivoting the stop away from the pile.

15. The method of claim 3, wherein said causing a stabbing member to be inserted into the pile comprises moving the stabbing member upwards into the pile, and wherein the method further comprises moving the stabbing member downward, after separated sheets are driven downward relative to the pile, and advancing the pile a second time.

16. The method of claim 3, wherein said step of driving the separated sheets downward relative to the pile comprises driving the separated sheets into a hole punch and punching said separated sheets.

17. The method of claim 16, further comprising, after punching said separated sheets, ejecting said punched sheets generally horizontally from said hole punch to an output tray.

* * * * *